US010669759B2

(12) United States Patent
Lu et al.

(10) Patent No.: US 10,669,759 B2
(45) Date of Patent: Jun. 2, 2020

(54) ADJUSTABLE HINGE ASSEMBLY OF MOUNTING DEVICE

(71) Applicant: HONGFUJIN PRECISION ELECTRONICS (TIANJIN) CO., LTD., Tianjin (CN)

(72) Inventors: Hsueh-Chin Lu, New Taipei (TW); Hung-Liang Chung, New Taipei (TW); Chih-Feng Chang, New Taipei (TW)

(73) Assignee: HONGFUJIN PRECISION ELECTRONICS (TIANJIN) CO., LTD., Tianjin (CN)

( * ) Notice: Subject to any disclaimer, the term of this patent is extended or adjusted under 35 U.S.C. 154(b) by 0 days.

(21) Appl. No.: 16/147,592

(22) Filed: Sep. 29, 2018

(65) Prior Publication Data

US 2020/0024879 A1 Jan. 23, 2020

(30) Foreign Application Priority Data

Jul. 20, 2018 (CN) ..... 2018 1 0808931

(51) Int. Cl.
*E05D 7/04* (2006.01)
*E05D 3/02* (2006.01)
*E05D 5/12* (2006.01)

(52) U.S. Cl.
CPC ..... *E05D 3/02* (2013.01); *E05D 5/12* (2013.01); *E05D 7/0423* (2013.01); *E05Y 2201/10* (2013.01); *E05Y 2600/12* (2013.01); *E05Y 2900/132* (2013.01)

(58) Field of Classification Search
CPC ..... Y10T 16/53225; Y10T 16/53235; Y10T 16/53238; Y10T 16/53253; Y10T 16/53257; E05D 3/02; E05D 5/12; E05D 7/04; E05D 7/0423; E05D 2007/0484
See application file for complete search history.

(56) References Cited

U.S. PATENT DOCUMENTS 516,546 A * 3/1894 McCauley ..... E05D 11/082 16/338
863,128 A * 8/1907 Aebi ..... E05D 7/0027 16/243
4,381,580 A * 5/1983 Hellstrom ..... E05D 7/0027 16/243
5,058,236 A * 10/1991 Henson ..... E05D 7/0027 16/222

(Continued)

FOREIGN PATENT DOCUMENTS

CN 204663239 U * 9/2015 ..... E05D 7/0045
DE 102011006023 B3 * 8/2012 ..... E05D 7/0045

(Continued)

*Primary Examiner* — Chuck Y Mah
(74) *Attorney, Agent, or Firm* — ScienBiziP, P.C.

(57) ABSTRACT

An adjustable hinge assembly includes a first hinge leaf, a second hinge leaf hinge-coupled to the first hinge leaf, and a hinge pin. The first hinge leaf defines a first knuckle hole corresponding to the hinge pin, and the second hinge leaf defines a second knuckle hole corresponding to the hinge pin. The first hinge leaf is hinge-coupled to the second hinge leaf by the hinge pin, the first knuckle hole, and the second knuckle hole. The hinge pin is movable within the first knuckle hole to adjust a position of the first hinge leaf relative to the second hinge leaf.

10 Claims, 3 Drawing Sheets

(56) References Cited

U.S. PATENT DOCUMENTS

| | | | | | |
|---|---|---|---|---|---|
| 5,966,778 | A * | 10/1999 | Ray | E05D 11/082 | 16/262 |
| 6,212,734 | B1 * | 4/2001 | Commons | E05D 7/0027 | 16/243 |
| 6,276,025 | B1 * | 8/2001 | Leibman | E05D 5/06 | 16/240 |
| 6,397,432 | B1 * | 6/2002 | di Vinadio | E05D 7/0045 | 16/235 |
| 8,925,150 | B2 * | 1/2015 | Pacini | E05D 7/0054 | 16/235 |
| 2015/0330129 | A1 * | 11/2015 | Hendrickson, Jr. | E05D 7/0027 | 16/244 |
| 2016/0201369 | A1 * | 7/2016 | Criddle | E05D 7/0045 | 16/238 |

FOREIGN PATENT DOCUMENTS

| | | | | |
|---|---|---|---|---|
| FR | 2964135 | A1 * | 3/2012 | E05D 7/0027 |
| GB | 2481371 | A * | 12/2011 | E05D 7/0423 |
| JP | 2002349118 | A * | 12/2002 | E05D 7/0027 |

* cited by examiner

ADJUSTABLE HINGE ASSEMBLY OF MOUNTING DEVICE

FIELD

The subject matter herein generally relates to mounting device including an adjustable hinge assembly.

BACKGROUND

Generally, hinge assemblies, such as those used in door assemblies, include a first hinge leaf fixed to a doorframe and a second hinge leaf fixed to the door. Sometimes, the door may be offset relative to the doorframe by the hinge assembly. Other times, a position of the door relative to the doorframe may change over time, thereby affecting performance of the hinge assembly.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
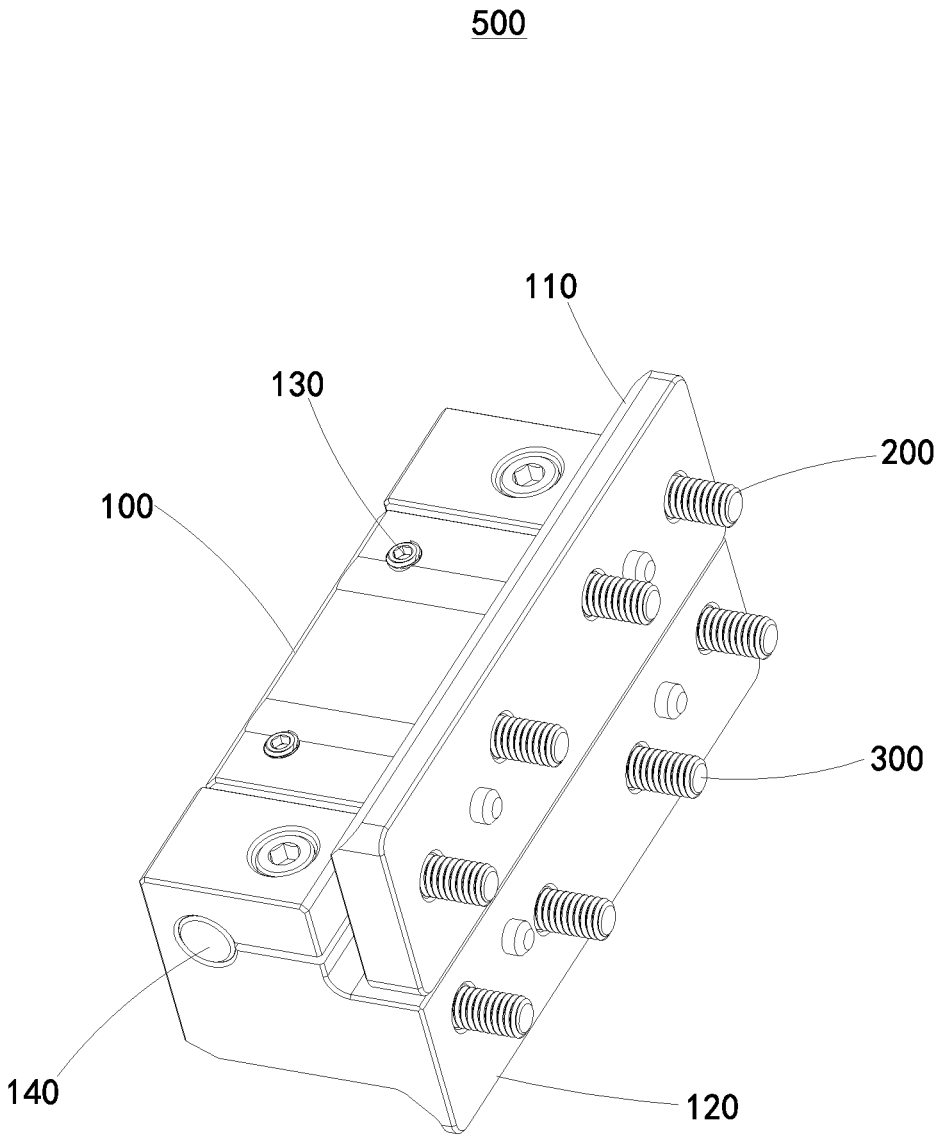
FIG. 1 is an assembled, isometric view of a hinge assembly in accordance with an embodiment of the present disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
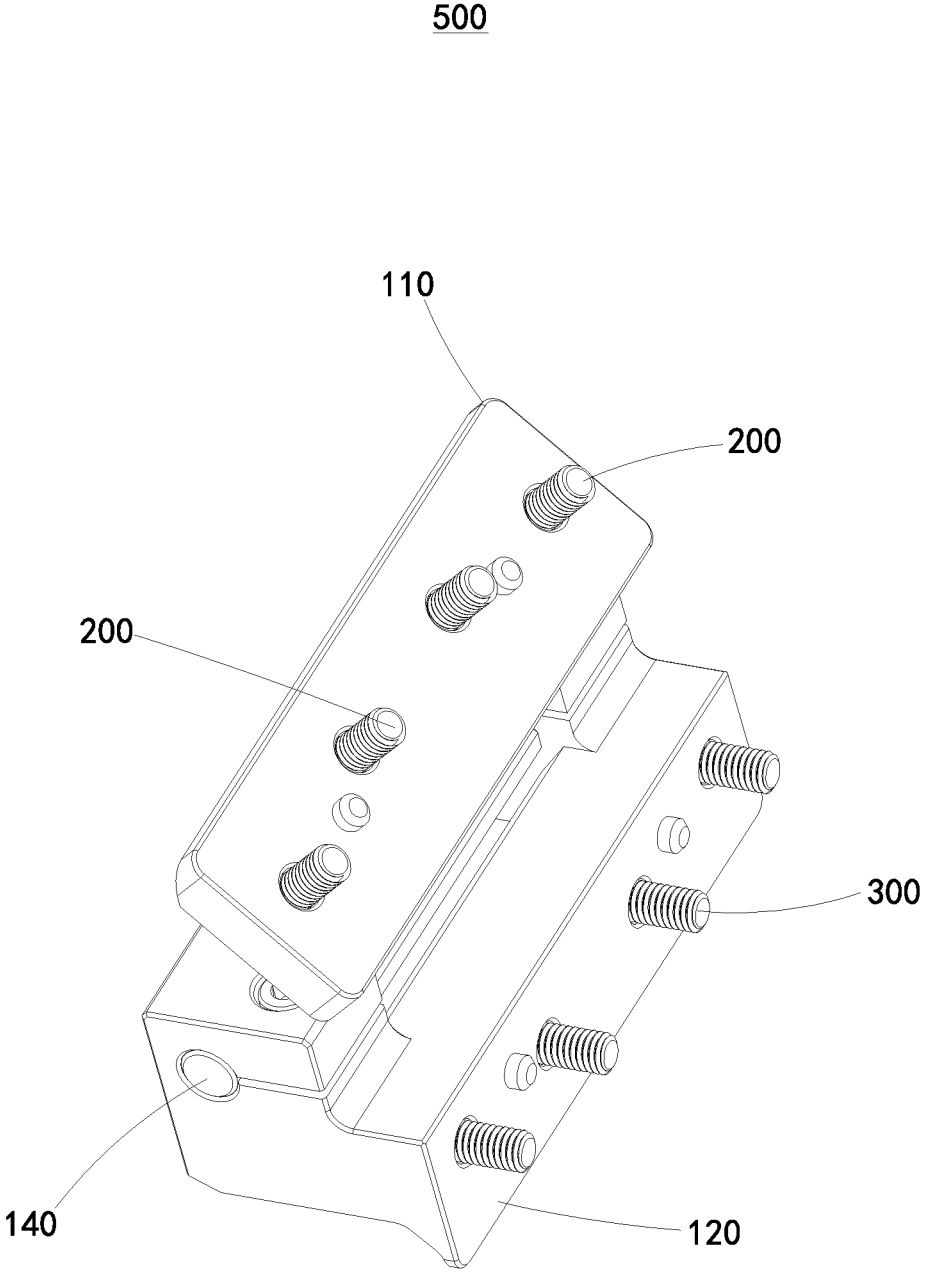
FIG. 2 is similar to FIG. 1, but shows the hinge assembly in accordance with an embodiment of the present disclosure.
Figure 3:
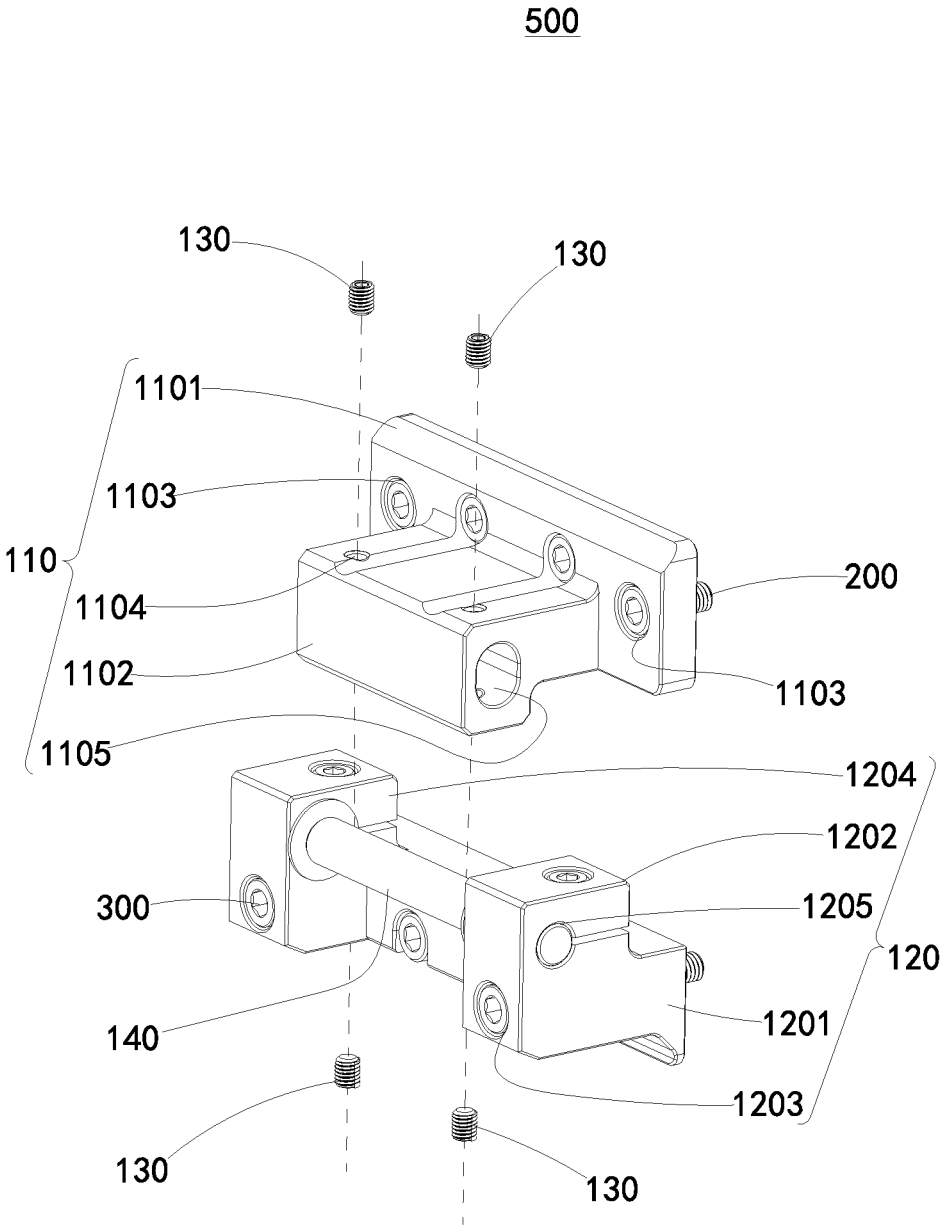
FIG. 3 is an isometric exploded view of the hinge assembly shown from another angle in accordance with an embodiment of the present disclosure.

FIGS. 1-3 show an embodiment of a mounting device 500 including an adjustable hinge assembly 100, a first mounting screw 200 and a second mounting screw 300.

The adjustable hinge assembly 100 includes a first hinge leaf 110, a second hinge leaf 120, and a hinge pin 140.

The second hinge leaf 120 is hinge-coupled to the first hinge leaf 110.

The first mounting screw 200 is installed on the first hinge leaf 110, and the second mounting screw 300 is installed on the second hinge leaf 120.

For example, in at least one embodiment, the first hinge leaf 110 includes a first connecting portion 1101 and a first fixing portion 1102. The first fixing portion 1102 is coupled to the first connecting portion 1101. The first fixing portion 1102 defines a first fixing hole 1103. The first mounting screw 200 is installed within the first fixing hole 1103.

The second hinge leaf 120 includes a second connecting portion 1201 and a second fixing portion 1202. The second fixing portion 1202 is coupled to the second connecting portion 1201. The second fixing portion 1202 defines a second fixing hole 1203. The second mounting screw 300 is installed within the second fixing hole 1203.

The first connecting portion 1101 is hinge-coupled to the second connecting portion 1201.

The first mounting screw 200 may fix a first external component (not shown) to the first hinge leaf 110. The second mounting screw 300 may fix a second external component (not shown) to the second hinge leaf 120. Thus, the first external component and the second external component are hinge-coupled by the adjustable hinge assembly 100.

The first hinge leaf 110 defines a first knuckle hole 1105, and the second hinge leaf 120 defines a second knuckle hole 1205. The first knuckle hole 1105 and the second knuckle hole 1205 correspond to the hinge pin 140.

A cross-section of the first knuckle hole 1105 is substantially an elongated hole.

The first hinge leaf 110 is hinge-coupled to the second hinge leaf 120 by the hinge pin 140, the first knuckle hole 1105, and the second knuckle hole 1205. The hinge pin 140 is movable within the first knuckle hole 1105 to adjust a position of the first hinge leaf 110 relative to the second hinge leaf 120.

In detail, a cross-section of the first knuckle hole 1105 is substantially an elongated hole. For example, a cross-section of the first knuckle hole 1105 may be a kidney-shaped hole. A cross-section of the second knuckle hole 1205 is substantially round corresponding to a shape of the hinge pin 140. The hinge pin 140 is installed within the second knuckle hole 1205, and a position of the hinge pin 140 relative to the second hinge leaf 120 is fixed.

Since the hinge pin 140 is movable within the first knuckle hole 1105, a position of the first hinge leaf 110 relative to the second hinge leaf 120 is adjustable. When a shape, size, assembly, or other factor which causes offset alignment of the first and second external components occurs, the position of the first hinge leaf 110 relative to the second hinge leaf 120 can be adjusted to improve alignment and function of the first and second external component.

In at least one embodiment, the second hinge leaf 120 includes a second connecting portion 1201 at each of two ends of the second hinge leaf 120. A limiting portion 1204 is formed on an inner side of each second connecting portion 1201. A position of the first hinge leaf 110 hinge-coupled to the second hinge leaf 120 is limited between the limiting portions 1204.

In at least one embodiment, the adjustable hinge assembly 100 further includes an adjustment member 130. The adjustment member 130 is installed on the first hinge leaf 110 and configured to abut the hinge pin 140.

When the hinge pin 140 is moved within the first knuckle hole 1105 to a desired position, the adjustment member 130 is moved to abut the hinge pin 140 and fix the position of the hinge pin 140.

In at least one embodiment, the adjustment member 130 is a plurality of adjustable screws. The first hinge leaf 110 defines a plurality of threaded holes 1104 corresponding to the plurality of adjustable screws and in communication with the first knuckle hole 1105. The adjustable screws are individually installed within each of the plurality of threaded holes 1104.

When the hinge pin 140 is moved within the first knuckle hole 1105 to the desired position, the adjustable screws are screwed in to abut the hinge pin 140 and fix the position of the hinge pin 140.

The adjustable screws are positioned around a periphery of the first knuckle hole 1105 to evenly distribute a holding force along the hinge pin 140.

In the adjustable hinge assembly 100 described above and the mounting device 500 using the adjustable hinge assembly 100, the cross-section of the first knuckle hole 1105 is an elongated hole. The first hinge leaf 110 is hinge-coupled to the second hinge leaf 120 by the hinge pin 140, the first knuckle hole 1105, and the second knuckle hole 1205. The hinge pin 140 is moved within the first knuckle hole 1105 to adjust the position of the first hinge leaf 110 relative to the second hinge leaf 120. Thus, the adjustable hinge assembly 100 is adjustable.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An adjustable hinge assembly comprising:
a first hinge leaf;
a second hinge leaf;
a hinge pin; and
an adjustment member comprises a plurality of adjustable screws;
wherein the first hinge leaf defines a first knuckle hole corresponding to the hinge pin, and the second hinge leaf defines a second knuckle hole corresponding to the hinge pin;
wherein the first hinge leaf is hinge-coupled to the second hinge leaf by the hinge pin, the first knuckle hole, and the second knuckle hole;
wherein the first hinge leaf defines a plurality of threaded holes corresponding to the plurality of adjustable screws;
wherein the hinge pin is movable within the first knuckle hole to adjust a position of the first hinge leaf relative to the second hinge leaf; and
wherein when the hinge pin is moved within the first knuckle hole to a predetermined position, the plurality of adjustable screws are screwed in the threaded holes correspondingly to abut an outer periphery of the hinge pin from two different direction to fix the position of the hinge pin.

2. The adjustable hinge assembly of claim 1, wherein the adjustable screws are positioned at an outer periphery of the first knuckle hole.

3. The adjustable hinge assembly of claim 1, wherein a cross-section of the first knuckle hole is an elongated hole.

4. The adjustable hinge assembly of claim 1, wherein a cross-section of the first knuckle hole is a kidney-shaped hole.

5. The adjustable hinge assembly of claim 1, wherein the second hinge leaf comprises a second connecting portion at each of two ends of the second hinge leaf, a limiting portion is formed on an inner side of each of the second connecting portion, a position of the first hinge leaf hinged-coupled to the second hinge leaf is limited between the limiting portions.

6. A mounting device comprising:
an adjustable hinge assembly;
a first mounting screw;
a second mounting screw; wherein the adjustable hinge assembly comprises:
a first hinge leaf;
a second hinge leaf hinge-coupled to the first hinge leaf; and
a hinge pin; and
an adjustment member comprises a plurality of adjustable screws;
wherein the first mounting screw is installed on the first hinge leaf, and the second mounting screw is installed on the second hinge leaf;
wherein the first hinge leaf defines a first knuckle hole corresponding to the hinge pin, and the second hinge leaf defines a second knuckle hole corresponding to the hinge pin;
wherein the first hinge leaf is hinge-coupled to the second hinge leaf by the hinge pin, the first knuckle hole, and the second knuckle hole;
wherein the first hinge leaf defines a plurality of threaded holes corresponding to the plurality of adjustable screws;
wherein the hinge pin is movable within the first knuckle hole to adjust a position of the first hinge leaf relative to the second hinge leaf; and
wherein when the hinge pin is moved within the first knuckle hole to a predetermined position, the plurality of adjustable screws are screwed in the threaded holes correspondingly to abut an outer periphery of the hinge pin from two different direction to fix the position of the hinge pin.

7. The mounting device of claim 6, wherein the adjustable screws are positioned at an outer periphery of the first knuckle hole.

8. The mounting device of claim 6, wherein a cross-section of the first knuckle hole is an elongated hole.

9. The mounting device of claim 6, wherein a cross-section of the first knuckle hole is a kidney-shaped hole.

10. The mounting device of claim 6, wherein the second hinge leaf comprises a second connecting portion at each of two ends of the second hinge leaf, a limiting portion is formed on an inner side of each of the second connecting portion, a position of the first hinge leaf hinged-coupled to the second hinge leaf is limited between the limiting portions.

* * * * *